US011162288B2

(12) United States Patent
Lee

(10) Patent No.: US 11,162,288 B2
(45) Date of Patent: Nov. 2, 2021

(54) DOOR HINGE

(71) Applicant: SEO WON KOREA CO., LTD., Gimhae-si (KR)

(72) Inventor: Juneyoung Lee, Gimhae-si (KR)

(73) Assignee: SEO WON KOREA CO., LTD., Gimhae-si (KR)

( * ) Notice: Subject to any disclaimer, the term of this patent is extended or adjusted under 35 U.S.C. 154(b) by 37 days.

(21) Appl. No.: 16/954,470

(22) PCT Filed: Dec. 13, 2018

(86) PCT No.: PCT/KR2018/015830

§ 371 (c)(1),
(2) Date: Jun. 16, 2020

(87) PCT Pub. No.: WO2019/124872

PCT Pub. Date: Jun. 27, 2019

(65) Prior Publication Data

US 2021/0079705 A1 Mar. 18, 2021

(30) Foreign Application Priority Data

Dec. 22, 2017 (KR) ..... 10-2017-0177863

(51) Int. Cl.
*E05F 3/20* (2006.01)
*E05D 11/10* (2006.01)

(52) U.S. Cl.
CPC ..... *E05F 3/20* (2013.01); *E05D 11/10* (2013.01)

(58) Field of Classification Search
CPC ..... E05F 3/20
See application file for complete search history.

(56) References Cited

U.S. PATENT DOCUMENTS 4,163,443 A * 8/1979 Peterson ..... E05C 5/00 126/197
5,937,481 A * 8/1999 Faringosi ..... F24C 15/023 16/332
6,035,848 A * 3/2000 Ray ..... F24C 15/022 126/194

(Continued)

FOREIGN PATENT DOCUMENTS

EP 3 095 940 A1 11/2016
KR 10-0744968 B1 8/2007

(Continued)

*Primary Examiner* — Jason W San
(74) *Attorney, Agent, or Firm* — Goldilocks Zone IP Law

(57) ABSTRACT

The present invention related to a door hinge for opening a door, which includes a cam fitted to the housing and hinged to the door, a roller that is in contact with an outer curved portion of the cam and is pushed backward according to the eccentric rotation of the cam, a damper case coupled with the roller and a pin and moving linearly backward according to the pushing pressure of the roller, a chamber formed at the end of the damper case, a guide tube extending to the end of the damper case in which the chamber is formed recessedly, a damper cover fixed the housing with a fastening pin and accommodating space is formed therein to accommodate the guide tube, a damper installed in the accommodating space of the damper cover, and a rod configured to exert a compressive force of the damper.

2 Claims, 5 Drawing Sheets

(56) References Cited

U.S. PATENT DOCUMENTS 6,986,187 B2 * 1/2006 Cummins ..... E05F 1/1276 16/286
7,934,290 B2 * 5/2011 Gherardi ..... F24C 15/023 16/288
8,572,811 B2 * 11/2013 Lautenschlager .... A47B 88/473 16/370
10,794,102 B2 * 10/2020 Vanini ..... E05F 5/02
2003/0172920 A1 * 9/2003 Gronbach ..... F24C 15/023 126/197
2006/0032019 A1 * 2/2006 Kistner ..... E05D 7/12 16/286
2007/0193572 A1 * 8/2007 Lee ..... E05D 7/12 126/194
2010/0109497 A1 * 5/2010 Blersch ..... E05F 1/1253 312/405
2012/0117755 A1 * 5/2012 Walhorn ..... E05F 3/104 16/66
2013/0031746 A1 * 2/2013 Hasegawa ..... E05F 5/00 16/50
2013/0239363 A1 * 9/2013 apur ..... E05F 5/006 16/50
2013/0239364 A1 * 9/2013 SirLouis ..... E05F 3/20 16/50
2014/0145576 A1 * 5/2014 White ..... E05F 1/1253 312/319.1
2016/0040466 A1 * 2/2016 Cooper ..... E05D 7/125 16/50
2016/0168897 A1 * 6/2016 Miglioranzo ..... E05F 3/104 16/50

FOREIGN PATENT DOCUMENTS

KR 10-2010-0055110 A 5/2010
KR 10-2011-0125727 A 11/2011
KR 10-2016-0111206 A 9/2016
KR 10-2017-0108482 A 9/2017

* cited by examiner

DOOR HINGE

CROSS-REFERENCE TO RELATED APPLICATIONS

This application claims the benefit under 35 U.S.C. section 371, of PCT International Application No.: PCT/KR2018/015830, filed on Dec. 13, 2018, which claims foreign priority to Korean Patent Application No.: 10-2017-0177863, filed on Dec. 22, 2017, in the Korean Intellectual Property Office, both of which are hereby incorporated by reference in their entireties.

TECHNICAL FIELD

The present invention relates to a door hinge, and more particularly, to a door hinge that enables a smooth opening operation without noise generation as well as a stable opening operation of the door by attenuating the speed of the door during the opening operation of the door.

BACKGROUND OF INVENTION

As is well known, the doors used in various electronic products such as cupboard doors, kimchi refrigerators, and washing machines or folding cell phones in kitchen furniture mainly use a bottom-up hinged door that opens up and down while rotating around a hinge axis.

The hinge device used in the above-described bottom-up hinged door rotates while being mounted at the end of the door and allows the closing operation of the door.

On the other hand, a compression spring is provided on the door hinge, and the compression spring generates a compressive force in a start section in which the closing operation of the door occurs, thereby slowing down the rotational speed of the shaft so that the door can rotate slowly.

A related art for a door hinge is, for example, Korean Patent Office Publication No. 10-2011-0125727 (TITLE: door hinge).

The above reference includes: a shaft coupled to the door while passing through the housing installed in the door and rotates according to the opening and closing operation of the door, a cam member is fitted to the outer circumference of the shaft, and the first and second inclined surfaces are formed on both sides, a first operating cam member, which is rotatably fitted to the outer circumference of the shaft, having a first operating inclined surface portion at the one side thereof by contacting with the first inclined portion of the cam member, moving in a horizontal direction through the first operating inclined surface portion in the process of rotating according to the operation of the shaft, a second operating inclined surface portion is located between the cam member and the door, one surface is fixed to the door, and the other surface forms a surface contact to the second inclined surface portion of the cam member, a compression spring that elastically supports the first operating cam member and generates a compressive force according to the pushing operation of the first operating cam member and the cam member to gradually close the door.

However, the above reference has a limitation in realizing a smoother closing operation by allowing the closing operation of the door to proceed slowly with only the compression force of the compression spring.

In addition, in the above reference, after the door opening operation is completed, it requires a means to secure the door in an open state so that the door does not deviate from a larger angle. But there was no means of holding the door open, so the opening of the door could not be stopped at a predetermined angle, such as when the door was fully opened and then falling backwards.

BACKGROUND DOCUMENTS

Patent Document

Patent Document 1: Korean Patent Publication No. 10-2011-0125727

INVENTION DISCLOSURE

Problems to be Solved

Accordingly, an object of the present invention for solving the above-described problems is to provide a door hinge that enables the door opening operation to be smoothly implemented without generating noise by the compression force of the compression spring and the resistance of the damper.

Another technical problem to be achieved by the present invention is to provide a door hinge that can maintain a fixed state without deviating from a predetermined angle after the door is opened and operated at an appropriate angle.

Means for Solving the Problems

The present invention for achieving the above object, a door hinge that can connect a door and a door frame and capable of open the door, may include a housing fixedly installed on the door frame, a cam fitted to the housing and coupled to the door and a hinge shaft configured to eccentrically rotate about hinge shaft according to an opening operation of the door; a roller in contact with the outer curved portion of the cam and being pushed backward according to the eccentric rotation operation of the cam; a damper case connected to the roller by a pin and configured to linearly move to a backward according to the pushing pressure of the roller; a chamber formed recessedly at the end of the damper case; a guide tube formed extendedly at an end of the damper case, in which a chamber is formed; a damper cover fixedly installed on the housing with a fastening pin and having an accommodating space for slidably inserting the guide tube; a damper installed in the accommodating space of the damper cover; a rod configured to exert a compressive force of the damper in the process of contacting with a wall surface of the chamber according to a backward movement of the damper case while being located in the chamber of the damper case after passing through the guide tube; and a main spring 80 inserted between the damper case and the damper cover and configured to exert a compressive force according to the backward movement of the damper case.

It is preferable that a guide hole is formed at an upper end of the damper case, a guide pin is fitted into the guide hole, and the guide pin is fixedly installed in the housing.

Effects of the Invention

The door hinge of the present invention can smoothly implement the opening operation of the door without generating noise due to the compression force of the compression spring and the resistance of the damper. Also, when the opening angle of the door reaches the highest point, the door is prevented from falling at an angle higher than the highest opening angle. By doing so, it has the effect of maintaining the opening angle of the door stably.

BRIEF DESCRIPTIONS OF DRAWINGS

DETAILED CONTENTS FOR CARRYING OUT THE INVENTION

Hereinafter, embodiments of the present invention will be described with reference to the accompanying drawings. In the detailed description to be described later, in order to achieve the above-described technical problems, two embodiments of the present invention will be representatively presented. And other embodiments that can be presented with the present invention are replaced with descriptions in the configuration of the present invention.

Figure 1:
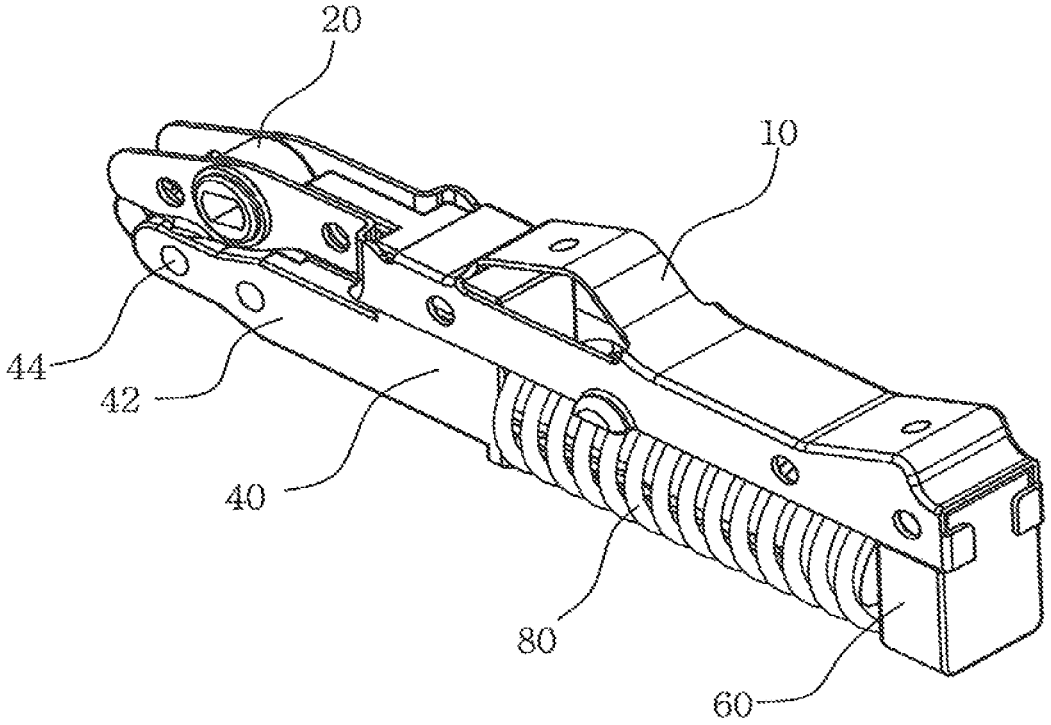
FIG. 1 is a three-dimensional view showing the configuration of a door hinge according to aspect(s) of the present invention.
Figure 2:
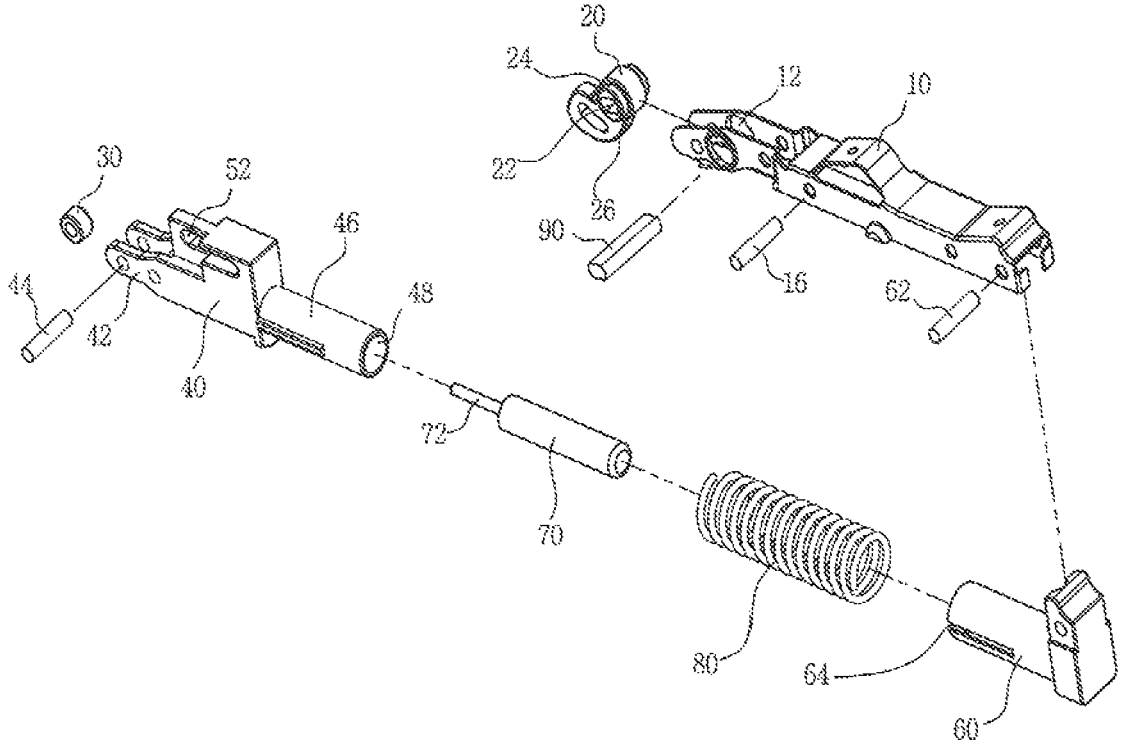
FIG. 2 is an exploded cross-sectional view showing an exploded configuration of the door hinge shown in FIG. 1.
Figure 3:
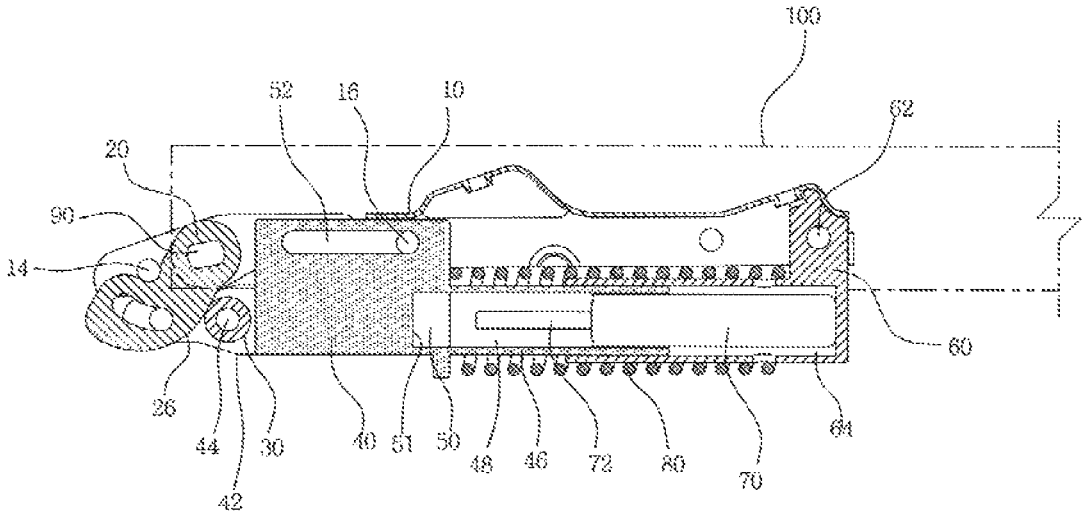
FIG. 3 is a cross-sectional view of the coupling of FIG. 2 according to aspect(s) of the present invention.

FIG. 1 is a diagram illustrating the overall configuration of a door hinge according to a preferred embodiment of the present invention, FIG. 2 is an exploded cross-sectional view of FIG. 1, and FIG. 3 is a combined cross-sectional view of FIG. 1.

As shown in FIGS. 1 to 3, the door hinge of the present invention is a hinge device used in a bottom-up hinged door, rotates while being mounted on the end of the door 100 and performs an open and close operation of the door 100.

The door hinge may include a housing 10, a cam 20, a roller 30, a damper case 40, a damper cover 60, a damper 70, and a main spring 80.

The housing 10 is coupled to the door 100 and the hinge shaft 90 while being fixed to the door frame 100 so that the door 100 may perform an opening operation in a bottom-up method about the hinge shaft 90, i.e., open operation of the door by vertically being erected in a horizontally lying state.

The housing 10 has a predetermined length, and the lower end is opened while the cam 20, the roller 30, the damper case 40, the damper cover 60, the damper 70, and the main spring 80 is configured to form a space 12 that can be supported in an accommodating state.

The cam 20 is connected to the hinge shaft 90 coupled to the housing 10. The cam 20 is an eccentric rotation member, which rotates about the hinge shaft when the hinge shaft 90 is rotated due to opening of the door 100.

A hole 22 for passing through the hinge shaft 90 is formed at the front end of the cam 20, and a coupling ring 24 is protruded along the peripheral surface of the hole 22, the coupling ring 24 is fitted into a hole 12 formed at the front end of the housing 10 and assembles the cam 20 to the front end of the housing 10. Through the hinge shaft 90 through the hole of the cam 20 assembled to the front end of the housing 10, the cam 20 and the door 100 are connected to the hinge shaft 90. The lower end of the cam 20 is configured to bend in one direction, and the roller 30 is configured to contact the lower outer curved surface 26 of the banded cam 20.

A locking pin 14 is coupled to the front end of the housing 10, and the closing operation of the door 100 is completed on the locking pin 14, and at the same time, the inner surface of the cam 20 is hung and the cam 20 is fixed so that it no longer rotates eccentrically.

The roller 30 performs an operation of being pushed backward according to the eccentric rotation operation of the cam 20 in contact with the outer curved portion 26 of the cam 20. The roller 30 is coupled to the bracket 42 formed in the front of the damper case 40 with a pin 44, and in accordance with the operation of the cam 20, the damper case 40 is pushed backward in the process of being pushed backward.

The damper case 40 is a member that slides in a linear direction back and forward according to an eccentric rotation of the cam 20 while being accommodated in the space 12 of the housing 10.

A guide hole 52, which is an elongate hole, is formed at an upper end of the damper case 40, and a guide pin 16 installed through the upper end of the housing 10 is fitted into the guide hole 52 and the damper case 40 guides the back and forward linear movement of the damper case 40.

Figure 5:
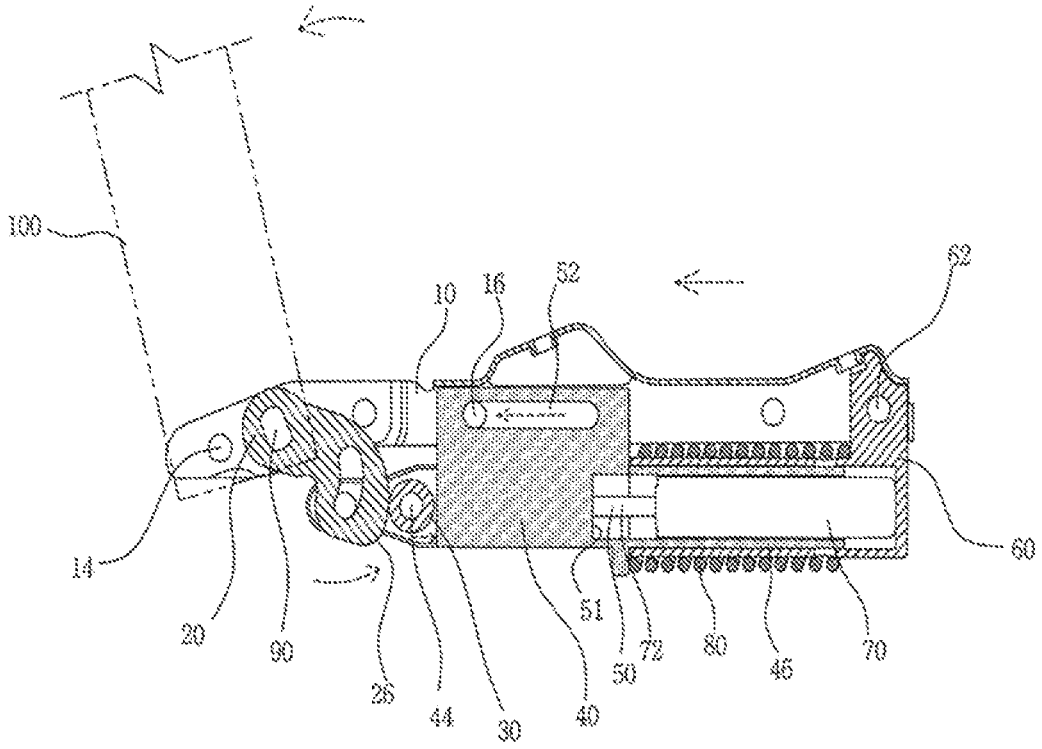

Meanwhile, as shown in FIG. 5, when the opening of the door 100 reaches the maximum angle, preferably 105°, one side of the guide hole 52 of the damper case 40 is hung on the guide pin 16. In addition, after the damper case 40 is moved to the back, is contacted with the damper cover 60 in a fixed state, at this time, the guide hole 52 caught in the guide pin 16 and the damper cover 60 in contact with each other and the damper case 40 is to perform a function of a stopper, thus the door 100 is able to maintain the open state at an angle of 105° without falling back out of the angle of 105° or more according to an aspect of the present invention. However, it is not limited thereto.

A bracket 42 is installed at the front end of the damper case 40, and a roller 30 in contact with the outer curved portion 26 of the cam 20 is coupled to the bracket 42 with the pin 44. In the process of the roller being pushed by the eccentric rotation operation of the cam, the damper case is linearly moved backward, and linearly moved forward again by the compression force of the damper 70 and the main spring 80.

A guide tube 46 may be integrally formed at the end of the damper case 40, and while guide tube 46 being inserted into the inner accommodating space 64 of the damper cover 60, and it moves back and forth in the inner accommodating space 64 of the damper cover 60 according to a back and forward linear movement of the damper case 40.

A chamber 50 may be formed further recessed at the end of the damper case 40. The chamber 50 has a function to press the damper 70 after the movement of the damper case 40 to a certain extent in the state connected to the guide tube 46 to exert a compressive force.

A rod 72 of the damper 70 is formed extended to at an end of the damper 70.

That is, the rod 72 of the damper 70 fitted in the damper cover 60 passes through the guide tube 46, at this time, the tip of the rod 72 does not contact the end of the damper case 40, the rod 72 is located in the chamber 50, which is recessedly formed at the end of the damper case 40. In this state, when the opening of the door 100 proceeds, and the opening angle of the door 100 reaches 60°, the rod 72 while the damper case 40 moves backward as much as the opening operation of the door 100, after passing through the chamber 50, comes into contact with the inner wall surface 51 of the chamber 50, at this time, since the rod 72 of the damper 70 is brought into contact with the inner wall surface 51 of the chamber 50, the compressive force of the damper 70 is exerted, so that the opening operation of the door 100 proceeds smoothly.

The damper cover 60 is a member which is fixedly installed in the housing 10 by being coupled to the housing 10 by a fastening pin 62 while being accommodated in the space of the housing 10.

The damper cover 60 is fixed in a state in which the accommodating space 64 is formed therein while the damper 70 is accommodated in the accommodating space 64.

In addition, between the damper 70 and the accommodating space 64 of the damper cover 60, the guide tube 46 of the above-described damper case 40 is fitted to be able to slide movement of back and forward.

The damper 70 generates a compressive force when the damper case 40 performs a linear movement to the backward due to the opening operation of the door 100 in a state accommodated in the accommodating space 64 of the damper cover 60. The damper is a member that induces the opening operation of the door 100 to proceed smoothly.

The rod 72 of the damper 70 passes through the guide tube 46 and is located in the chamber 50 which is recessed at the end of the damper case 40. At this time, when the damper case 40 starts to move backward by the opening operation of the door 100, after the rod 72 of the damper 70 passes through the chamber 50, the rod 72 is pushed out in the process of contacting the inner wall 51 of the chamber 50 and generates the compressive force of the damper 70.

The above main spring 80 is located between the above damper case 40 and the above damper cover 60 and generates a compression force according to the backward movement of the above damper case 40 to attenuate the opening speed of the door 100 together with the aforementioned damper 70 to induce the door 100 to operate stably open.

Hereinafter, the opening operation process of the door hinge according to the present invention will be described with reference to FIGS. 3 to 5.

Figure 4:
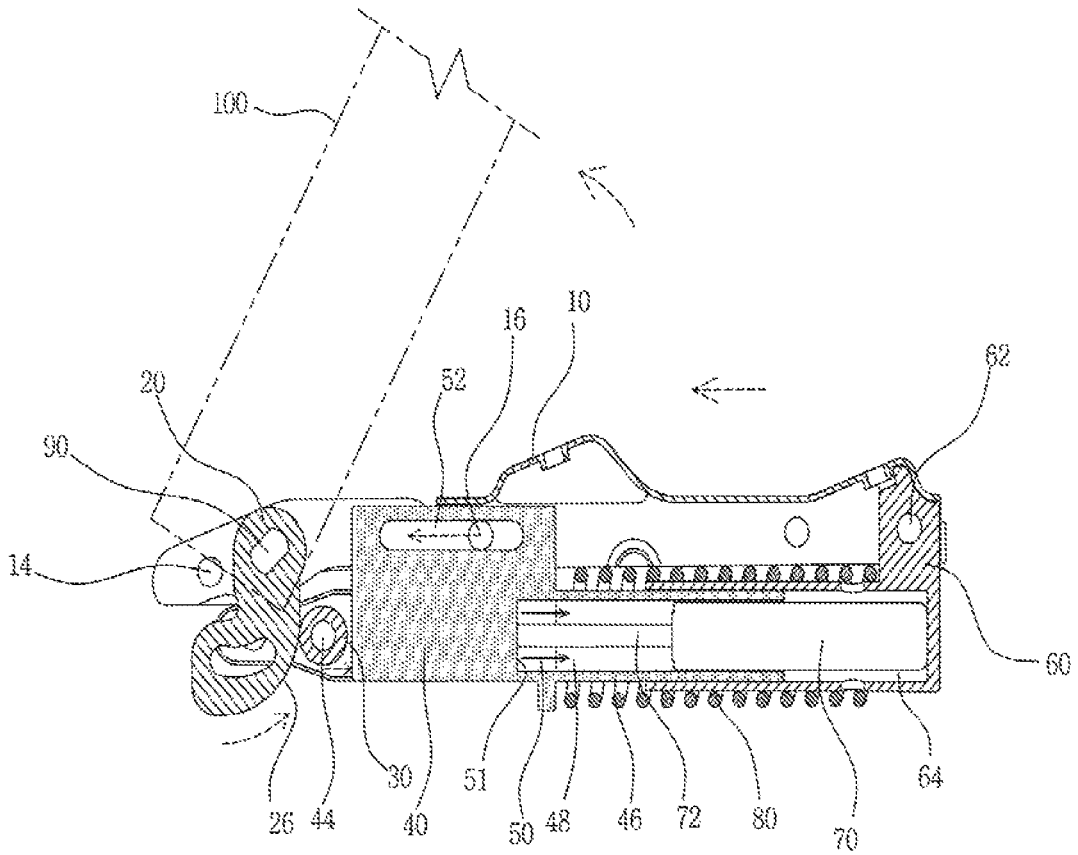
FIGS. 4 and 5 are views sequentially showing the opening process of the hinged door according to aspect(s) of the present invention.

First, when you want to open the door 100, when holding the door handle and lifting it upward, the cam 20 forming the door hinge as shown in FIG. 4 is composed of the door 100 and the hinge shaft 90. In the rotation operation of the hinge shaft 90 according to the opening operation of the door. When the cam 20 performs a rotation operation, the roller 30 in contact with the outer curved portion of the cam 20 is pushed backward, accordingly, the damper case 40 having the bracket 42 coupled to the roller 30 and the pin 44 is moved backward through the roller 30. When the damper case 40 moves backward, the guide tube 46 formed at the end of the damper case 40 moves backward while being fitted in the accommodating space 64 of the damper cover 60.

Next, as shown in FIG. 5, when the opening angle of the door 100 reaches 60°, the rod 72 of the damper 70 accommodated in the accommodating space of the damper cover 60 is the backward of the damper case 40. After passing through the chamber 50 formed in the end of the damper case 40 according to the movement.

The chamber 50 is pushed out in contact with the inner wall surface 51 of the chamber 50. Accordingly, the damper 70 primarily generates a compressive force so that the opening of the door 100 can proceed smoothly and slowly after the opening angle of the door 100 passes 60°. Next, as shown in FIG. 6, when the opening operation of the door 100 continues to progress and the opening angle of the door reaches 105°, the damper case 40 continuously moves backward and contacts the front end of the damper cover 60. In addition, the guide hole 52 of the damper case 40 is stuck on the guide pin 16 of the housing 10.

At this time, the contact between the damper cover 60 and the damper case 40, and the jamming of the guide hole 52 and the guide pin 16, as a result, prevents the door 100 from opening over an angle of 105° or more, the door maintaining to open an angel of 105°.

However, it is not limited thereto. It is understood that the open angle of the door, 105° can be changed with a predetermined angle according to aspect(s) of the present invention.

| EXPLANATIONS OF SYMBOLS |
|---|
| 10: housing |
| 16: guide pin |
| 20: cam |
| 26: outer covered portion |
| 30: roller |
| 40: damper case |
| 42: bracket |
| 46: guide tube |
| 50: chamber |
| 52: guide hole |
| 60: damper cover |
| 70: damper |
| 72: rod |
| 80: main spring |

What is claimed is:

1. A door hinge that can connect a door and a door frame and capable of opening the door, comprising:

a housing fixedly installed on the door frame;

a cam fitted to the housing and coupled to the door and a hinge shaft configured to eccentrically rotate about the hinge shaft according to an opening operation of the door;

a roller in contact with the outer curved portion of the cam and being pushed backward according to the eccentric rotation operation of the cam;

a damper case connected to the roller by a pin and configured to linearly move to a backward according to the pushing pressure of the roller;

a chamber formed recessedly at the end of the damper case a damper cover fixedly installed on the housing with a fastening pin and having an accommodating space for slidably inserting the guide tube;

a damper installed in the accommodating space of the damper cover;

a rod configured to exert a compressive force of the damper in the process of contacting with a wall surface of the chamber according to a backward movement of the damper case while being located in the chamber of the damper case after passing through the guide tube; and a main spring inserted between the damper case and the damper cover and configured to exert a compressive force according to the backward movement of the damper case.

2. The door hinge of claim 1, further comprising:

a guide hole formed at an upper end of the damper case; and a guide pin fitted to the guide hole, wherein the guide pin is fixedly installed in the housing.

* * * * *